US008197104B2

(12) United States Patent
Chang

(10) Patent No.: US 8,197,104 B2
(45) Date of Patent: Jun. 12, 2012

(54) SECONDARY OPTICAL LAMP GUARD

(75) Inventor: Jacky Chang, Taoyuan (TW)

(73) Assignee: UP Key Light & Energy Technology Co., Ltd. (TW)

( * ) Notice: Subject to any disclaimer, the term of this patent is extended or adjusted under 35 U.S.C. 154(b) by 243 days.

(21) Appl. No.: 12/797,849

(22) Filed: Jun. 10, 2010

(65) Prior Publication Data

US 2010/0321943 A1 Dec. 23, 2010

(30) Foreign Application Priority Data

Jun. 19, 2009 (TW) ..... 98120715 A

(51) Int. Cl.
*F21V 5/00* (2006.01)

(52) U.S. Cl. ..... 362/311.06; 362/311.14; 362/317; 362/334; 362/340

(58) Field of Classification Search ..... 362/311.06, 362/311.14, 317, 322, 331, 333, 334, 340
See application file for complete search history.

(56) References Cited

U.S. PATENT DOCUMENTS

| | | | | | |
|---|---|---|---|---|---|
| 1,139,295 | A * | 5/1915 | Jones | 200/52 R |
| 1,839,022 | A * | 12/1931 | Froget | 362/334 |
| 5,095,415 | A * | 3/1992 | Anderson et al. | 362/329 |
| 5,746,502 | A * | 5/1998 | Huang | 362/223 |
| 6,048,083 | A * | 4/2000 | McDermott | 362/337 |
| 6,099,148 | A * | 8/2000 | Northrup et al. | 362/336 |
| 6,540,381 | B1 * | 4/2003 | Douglass, II | 362/311.09 |
| 7,748,874 | B2 * | 7/2010 | Cho | 362/340 |
| 8,057,073 | B2 * | 11/2011 | Lee | 362/340 |
| 8,075,167 | B2 * | 12/2011 | Shin | 362/340 |

* cited by examiner

*Primary Examiner* — John A Ward
(74) *Attorney, Agent, or Firm* — Schmeiser, Olsen & Watts, LLP

(57) ABSTRACT

A secondary optical lamp guard includes an upper half portion, two clamp portions and a lower half portion, and the upper half portion has a plurality of optical refractive angles formed on an internal side of the upper half portion for improving the effect of the optical refractive angles, and the upper half portion and the lower half portion are processed by a plasma treatment to produce nanoscale holes for facilitating the dissipation of heat generated by a light source.

14 Claims, 1 Drawing Sheet

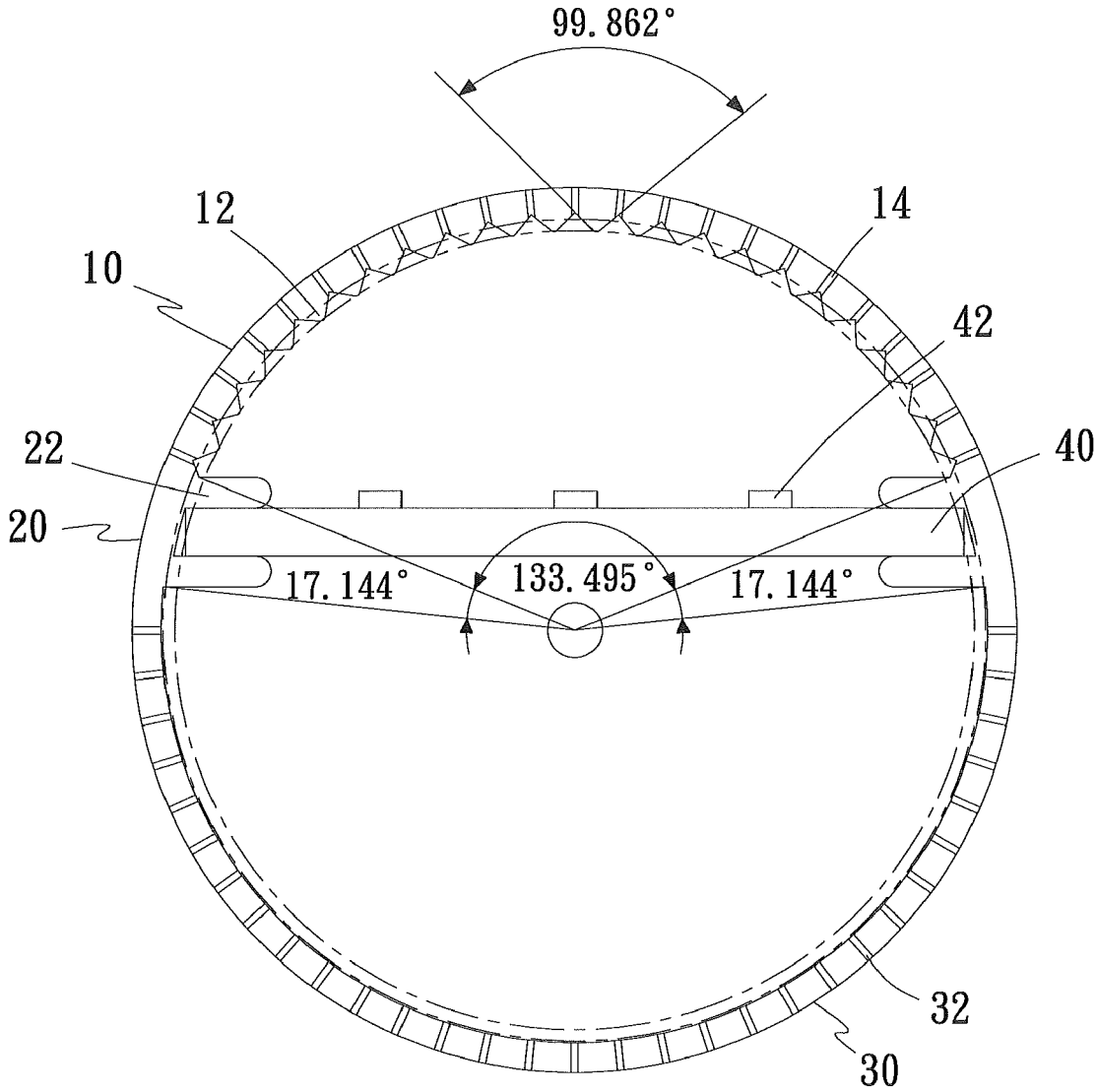
99.862°
12
14
10
42
22
40
20
17.144°
133.495°
17.144°
32
30

SECONDARY OPTICAL LAMP GUARD

CROSS-REFERENCE TO RELATED APPLICATIONS

This non-provisional application claims priority under 35 U.S.C. §119(a) on Patent Application No(s). 098120715 filed in Taiwan, R.O.C. on Jun. 19, 2009, the entire contents of which are hereby incorporated by reference.

FIELD OF THE INVENTION

The present invention relates to a secondary optical lamp guard, in particular to a functional characteristic or a component of a lamp guard having a special shape and a surface treatment of an illumination device or its system.

BACKGROUND OF THE INVENTION

Light emitting diode (LED) is a semiconductor light source applied extensively in the areas of an indicator lamp and a display panel at an early stage and then used increasingly for lighting as white light LED was introduced. LED has become a new light source of the 21$^{st}$ century. Incomparable by other traditional light sources, the LED has advantages such as high efficiency, long life and good durability. If a positive voltage is applied, the LED will be able to emit monochromatic discrete lights, which is an electroluminescent effect. By changing the chemical composition of a semiconductor material, the LED can emit a near ultraviolet light, a visible light or an infrared light, but the conventional way of using the LED as a light source for illumination lamps is limited by the properties of the LED and usually has the following problems: 1. Since the light source is directional, it is necessary to consider the optical properties of the LED for its design. 2. There is a heat dissipation issue, and poor heat dissipations will reduce the life of the LED greatly.

It is a main subject for the present invention to disclose a secondary optical lamp guard capable of increasing the angle of the light reflection angles, and dissipating heat generated by the light source.

SUMMARY OF THE INVENTION

In view of the shortcomings of the conventional illumination lamps, the inventor of the present invention based on years of experience in the related industry to conduct extensive researches and experiments, and finally developed a secondary optical lamp guard to achieve the effects of increasing the angle of the light refraction angles, and facilitating the dissipation of heat generated by the light source.

Therefore, it is a primary objective of the present invention to provide the secondary optical lamp guard to overcome the shortcomings of the prior art.

To achieve the foregoing objective, the present invention discloses a secondary optical lamp guard which is a circular cylinder made of a polycarbonate (PC) material, and the secondary optical lamp guard comprises: an upper half portion, being a first arc length portion of the circular cylinder, and having a plurality of optical refractive angles formed on an internal side of the upper half portion; two clamp portions, being a second arc length portion disposed separately on both sides of the upper half portion, and having a clamp element separately installed on internal sides of the clamp portions; and a lower half portion, being a third arc length portion of the circular cylinder; wherein the sum of angles resulted from the first arc length portion, the second arc length portion and the third arc length portion is equal to 360 degrees, and the upper half portion has a plurality of upper holes, and the lower half portion has a plurality of lower holes, and the ratio of internal diameter to external diameter of the circular cylinder is equal to 0.807 to 0.929, and the ratio of thickness to external diameter of the optical refractive angle is equal to 0.021 to 0.024.

Therefore, the secondary optical lamp guard of the present invention can achieve the effects of increasing the angle of the light refraction angles and facilitating the dissipation of heat generated by the light source.

BRIEF DESCRIPTION OF THE DRAWING

FIG. 1 is a cross-sectional view of a preferred embodiment of the present invention.

DESCRIPTION OF THE PREFERRED EMBODIMENTS

The objects, characteristics and effects of the present invention will become apparent with the detailed descriptions of the preferred embodiment and the illustrations of related drawings as follows.

With reference to FIG. 1 for a cross-sectional view of a secondary optical lamp guard in accordance with a preferred embodiment of the present invention, the secondary optical lamp guard is a circular cylinder made of a polycarbonate (PC) material, and comprises: an upper half portion 10, two clamp portions 20 and a lower half portion 30. The upper half portion 10 constitutes a first arc length portion of the circular cylinder, and the upper half portion 10 has a plurality of optical refractive angles 12 formed on an internal side of the upper half portion 10 and arranged with or without an interval apart from each other. The clamp portions 20 include a second arc length portion separately formed on both sides of the upper half portion 10, and a clamp element 22 separately formed on internal sides of the clamp portion 20. The lower half portion 30 constitutes a third arc length portion of the circular cylinder, wherein the sum of angles resulted from the first arc length portion, the second arc length portion and the third arc length portion is equal to 360 degrees, and the upper half portion 10 has a plurality of upper holes 14, and the lower half portion 30 has a plurality of lower holes 32, and the ratio of internal diameter to external diameter of the circular cylinder is equal to 0.807 to 0.929, and the ratio of thickness to external diameter of the optical refractive angle is equal to 0.021 to 0.024.

In a preferred embodiment of the present invention, the circular cylinder has an internal diameter of 23 to 26.5 mm, and the circular cylinder has an external diameter of 25 to 28.5 mm, and the circular cylinder has an external diameter greater than the internal diameter of the circular cylinder, and the ratio of internal diameter to external diameter of the circular cylinder is preferably equal to 0.906. For example, the internal diameter of the circular cylinder is equal to 24.94 mm, and the external diameter of the circular cylinder is equal to 27.54 mm, and the refractive index is equal to 1.586. The ratio of thickness to external diameter of the optical refractive angle is preferably equal to 0.022, and the thickness of the optical refractive angle is equal to 0.6 mm, and the circular cylinder has an external diameter of 27.54 mm The first arc length portion of the upper half portion 10 results in an angle of 100 to 150 degrees, and preferably equal to 133.495 degrees, and the optical refractive angle is equal to 85 to 110 degrees, and the quantity of optical refractive angles is equal to 9 to 22, and the optical refractive angle is preferably equal to 99.862 degrees, and the quantity of optical refractive angles is preferably equal to 20. As shown in FIG. 1, the optical refractive angles 12 are arranged without any interval apart from each other. The upper half portion 10 is processed by a plasma treatment and has a plurality of upper holes 14 with a diameter of 20 to 25 nm.

Experiments show that the refraction angle of a light source provided by the LED 42 is increased by the design of the optical refractive angles 12 to reduce inconvenience caused by the directionality of the LED light source.

The angle resulted from the second arc length portion of the clamp portion 20 is equal to 17.144 degrees, and the clamp portion 20 includes a clamp element 22 installed separately on internal sides of the clamp portions 20 and provided for holding and fixing an LED circuit substrate 40, and the LED circuit substrate 40 includes a plurality of LEDs 42, wherein both upper and lower portions of the clamp element 22 of this preferred embodiment have a thickness of 0.7 mm, and an interval between the upper and lower portion is equal to 1.636 mm The angle resulted from the third arc length portion of the lower half portion 30 is equal to 192.217 degrees, and the third arc length portion is processed by a plasma treatment and includes a plurality of lower holes 32, each having a diameter of 80 nm In the secondary optical lamp guard of the present invention, the upper half portion 10 and the lower half portion 30 are processed by a plasma treatment and produce nanoscale upper and lower holes 14, 32 with a size of 20 nm to 25 nm and 80 nm respectively, such that refraction angle of the light source of the LED 42 will not be affected, and the heat generated by the LED 42 can be dissipated easily.

The present invention comes with a plurality of optical refractive angles, and the upper half portion and the lower half portion are processed by a plasma treatment to achieve the effects of increasing the light refraction angle and facilitating the dissipation of heat generated by the light source, and the invention also complies with the patent application requirements, and products derived from the present invention can satisfy the current market requirements sufficiently.

While the invention has been described by means of specific embodiments, numerous modifications and variations could be made thereto by those skilled in the art without departing from the scope and spirit of the invention set forth in the claims.

What is claimed is:

1. A secondary optical lamp guard, being a circular cylinder made of polycarbonate (PC), comprising:

an upper half portion, being a first arc length portion of the circular cylinder, and including a plurality of refractive angles formed on an internal side of the upper half portion;

two clamp portions, being a second arc length portion formed separately on both sides of the upper half portion, and having a clamp element installed on internal sides of the clamp portions separately; and a lower half portion, being a third arc length portion of the circular cylinder;

wherein angles resulted from the first arc length portion, the second arc length portion and the third arc length portion respectively sums up to 360 degrees, and the upper half portion includes a plurality of upper holes, and the lower half portion includes a plurality of lower holes, and a ratio of internal diameter to external diameter of the circular cylinder is equal to 0.807 to 0.929, and a ratio of thickness to external diameter of the optical refractive angle is equal to 0.021 to 0.024.

2. The secondary optical lamp guard of claim 1, wherein the upper holes and the lower holes are processed by a plasma treatment.

3. The secondary optical lamp guard of claim 1, wherein the upper hole has a diameter of 20 nm to 25 nm, and the lower hole has a diameter of 80 nm.

4. The secondary optical lamp guard of claim 1, wherein the optical refractive angle has a ratio of thickness to external diameter preferably equal to 0.022.

5. The secondary optical lamp guard of claim 4, wherein the optical refractive angle has a thickness of 0.6 mm, and the circular cylinder has an external diameter of 27.54 mm.

6. The secondary optical lamp guard of claim 1, wherein the circular cylinder has an internal diameter of 23 mm to 26.5 mm, and the circular cylinder has an external diameter of 25 mm to 28.5 mm, and the circular cylinder has an external diameter greater than the internal diameter of the circular cylinder.

7. The secondary optical lamp guard of claim 6, wherein the circular cylinder has a ratio of internal diameter to external diameter preferably equal to 0.906.

8. The secondary optical lamp guard of claim 7, wherein the circular cylinder has an internal diameter equal to 24.94 mm and an external diameter equal to 27.54 mm.

9. The secondary optical lamp guard of claim 1, wherein the optical refractive angle is equal to 85 degrees to 110 degrees.

10. The secondary optical lamp guard of claim 9, wherein the quantity of optical refractive angles is equal to 9 to 22.

11. The secondary optical lamp guard of claim 10, wherein the optical refractive angle is preferably equal to 99.862 degrees, and the quantity of optical refractive angles is preferably equal to 20.

12. The secondary optical lamp guard of claim 1, wherein the first arc length portion is equal to 100 degrees to 150 degrees.

13. The secondary optical lamp guard of claim 12, wherein the first arc length portion results in an angle preferably equal to 133.495 degrees, and the second arc length portion and the third arc length portion results in angles equal to 17.144 degrees and 192.217 degrees respectively.

14. The secondary optical lamp guard of claim 1, wherein the circular cylinder has a refractive index equal to 1.586.

* * * * *